United States Patent [19]

Lattion

[11] 4,165,603

[45] Aug. 28, 1979

[54] APPARATUS FOR WAXING YARN USING SOLID WAX ON A TEXTILE MACHINE

[75] Inventor: André Lattion, Winterthur, Switzerland

[73] Assignee: Rieter Machine Works, Ltd., Winterthur, Switzerland

[21] Appl. No.: 793,291

[22] Filed: May 3, 1977

[30] Foreign Application Priority Data

May 26, 1976 [CH] Switzerland ..... 6634/76

[51] Int. Cl.[2] ..... D01H 13/30

[52] U.S. Cl. ..... 57/296; 118/78

[58] Field of Search ..... 57/35, 164, 295–296; 118/78

[56] References Cited

U.S. PATENT DOCUMENTS

| | | | |
|---|---|---|---|
| 1,546,301 | 7/1925 | Mathes | 118/78 |
| 1,624,844 | 4/1927 | Noga | 118/78 |
| 2,110,724 | 3/1938 | Goettel | 118/78 |
| 2,235,229 | 3/1941 | Lylton | 118/78 |
| 2,474,346 | 6/1949 | Coleman et al. | 118/78 |

FOREIGN PATENT DOCUMENTS

| | | | |
|---|---|---|---|
| 2227308 | 1/1973 | Fed. Rep. of Germany | 57/35 |

*Primary Examiner*—Charles Gorenstein
*Attorney, Agent, or Firm*—Kenyon & Kenyon

[57] ABSTRACT

A wax body is rotatably and slidably mounted on a guide pin which, in turn, is pivotally mounted about a horizontal axis. The guide pin and wax body are movable between a working position in which a yarn is run between the wax body and a stop on the guide pin and an idling position in which the wax body and guide pin are moved out of the path of the yarn. Yarn piecing up can be accomplished when the apparatus is in the idling position without interference from the wax body.

15 Claims, 3 Drawing Figures

APPARATUS FOR WAXING YARN USING SOLID WAX ON A TEXTILE MACHINE

This invention relates to an apparatus for waxing yarn. More particularly, this invention relates to an apparatus for waxing yarn using solid wax in a textile machine.

Various types of devices have been known for waxing yarns, particularly during processing in textile machines. One such type of device is described in German Patent Application DOS No. 2,217,952. In this device, a roll-shaped wax body is supported in a loose rotatable manner on an inclined guide pin and is used to wax a yarn which is pretensioned between two nip points. During use, the yarn is to contact the front side of the roll-shaped wax body which is provided with a center hole. At the same time, the wax body is loosely slidable over the whole length of the guide pin in order to level out the yarn path length differences caused by a yarn traversing motion. The wax body can slide freely along the guide pin due to the inclination of the pin until reaching a stop. The sliding path of the wax body is, however, limited by the yarn passing through. The yarn is thus deflected from a straight path between the two nip points, which can be formed e.g. by yarn take-off rolls, on the one hand, and by winding rolls, on the other hand, of an open-end spinning unit. The deflection angle thus depends on the yarn tension, the weight of the wax body and on the friction between the wax body and the guide pin. This device, however, has a number of substantial disadvantages.

One of these disadvantages resides in that a constant degree of yarn waxing is not ensured since the deflection of the yarn by the wax body at constant yarn tension is, among other influences, influenced as a function of the changing weight of the wax body. The contact force of the yarn on the wax body thus is not constant. This force, however, determines the wax quantities taken up by the yarn, i.e. as the wax body wears off and diminishes in weight, the wax take-up of the yarn diminishes continually during operation. Also, variations of the friction between the wax body and the guide pin result in changes in the contact force.

A further disadvantage resides in that the yarn is waxed in a one-sided contact as the yarn passes through freely.

Furthermore, this known device has a very important disadvantage in that, e.g. if used on an open-end spinning machine, as the yarn spinning process is started, e.g. after an end breakage, the wax body interferes with the yarn path. An operator is thus forced during the spinning start-up operation, which in itself is a very delicate operation requiring the full ability and attention of the operator, to also take care of the wax body in such a manner that the wax body does not impair the spinning start-up operation. Thus, the spinning start-up process is rendered more difficult and the source of disturbances is augmented. Also, the danger persists that the yarn may not be guided into proper position along the wax body after the spinning start-up process due to faulty manipulations by the operator. This again causes irregularities in the waxing process.

A further waxing device is also known according to German Patent Application DOS No. 2,105,558. In this device, a wax body, which is also of cylindrical shape is rotatably supported on a guide pin, the axis of which is at right angles with respect to a yarn distribution plane, and the axial position of the wax body is determined by a stop. The stop is made adjustable with respect to a guide rod for the yarn which is arranged above the face surface of the wax body and parallel to the axis of a grooved drum of a yarn winding device. This device allows the wax take-up rate of the yarn to be maintained constant independently of the weight of the wax body, as the wax body resting against the stop is to be considered as a fixed body, the weight of which is supported not by the yarn but by the free stop. This device, however, also has substantial disadvantages. In addition to the fact that in this device just as in the device mentioned before, the wax body interferes with the yarn path when used on an open-end spinning machine. Thus, this device also requires additional attention of the operator in such manner that the yarn started up is brought into contact with the face side and not with the cylindrical side of the wax body. A further disadvantage is that deactivation of the waxing device is relatively complicated, as dismantling of the wax body is required. This operation, however, cannot be effected without displacing the stop.

Accordingly, it is an object of the invention to ensure a constant waxing of a yarn.

It is another object of the invention to provide a waxing apparatus which does not interfere with an operator during a spinning start-up process on an open-end spinning unit.

It is another object of the invention to provide a waxing apparatus which permits a fast changeover from wax yarns to non-wax yarns without dismantling of parts.

It is another object of the invention to provide an apparatus for waxing yarns which is of economic construction and which is reliable in use.

Briefly, the invention provides an apparatus for waxing a yarn which is particularly useful in combination with an open-end spinning machine from which a yarn travels through a predetermined yarn traversing path. The waxing apparatus comprises a guide pin, a wax body and a stop on a pin. The guide pin is pivotally mounted on a horizontal axis parallel to the yarn traversing path for movement between a working position in which the pin projects through the path and an idling position in which the pin is located outside the path. The pin has a longitudinal axis disposed perpendicularly of the yarn traversing path with the pin in the working position.

The wax body is of cylindrical shape and is rotatably and axially movably mounted on the guide pin. The stop serves to determine the axial position of the wax body on the pin with the pin in the working position. The stop and the wax body are disposed on opposite sides of the yarn traversing path with the pin in the working position so that a yarn is guided between a face side of the wax body and the stop for waxing of the yarn in an enclosed condition.

In one embodiment, the stop is in the form of a cover which is supported on the guide pin. In addition, a quick-mounting means may be provided for securing the stop on the guide pin.

The wax body can be supported loosely in a rotatable manner on the guide pin. Also, the guide pin may itself be rotatable about the longitudinal axis thereof.

The guide pin is preferably pivoted in an upward direction in order to be brought from the working position to the idling position. In this manner, when a yarn piece-up operation is required, the waxing apparatus can be simply lifted up and out of the path of the yarn so as to avoid interference with the piecing up operation. Also, if a yarn is not to be waxed, the waxing apparatus can be simply lifted out of the way.

These and other objects and advantages of the invention will become more apparent from the following detailed description and appended claims taken in conjunction with the accompanying drawings in which:

Figure 1:
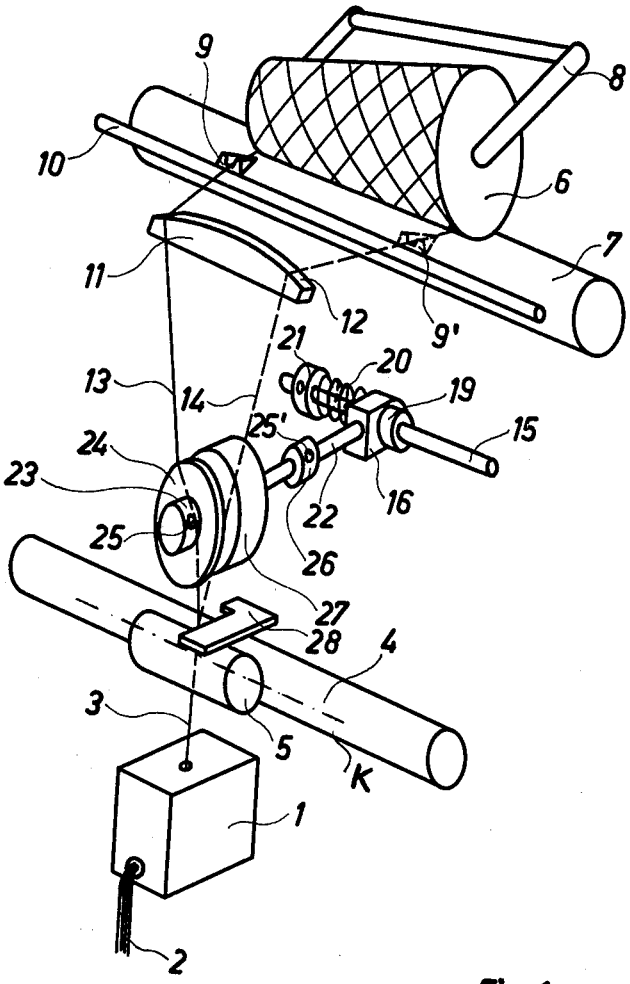
FIG. 1 illustrates an axonometric view of a waxing apparatus according to the invention on an open-end spinning machine.

Referring to FIG. 1, the open-end spinning machine 1 operates to transform a staple fiber sliver 2 in a known manner into a yarn by attenuation and twisting with the yarn being taken off by a pair of take-off rolls 4, 5 for winding into a cross-wound bobbin package 6 by a winding means arranged above the pair of take-off rolls 4, 5. The take-off rolls 4, 5 may consist, for example, of a shaft roll 4 which extends along all spinning units of a whole side of the open-end spinning machine and of a pressure roll 5 which is pressed against the roll 4 by a suitable means (not shown).

The winding means comprises a friction drive drum 7, a bobbin support arm 8 and a traversing thread or yarn guide 9. The friction drive drum 7 extends along all of the spinning units of the whole side of the open-end spinning machine 1 and is driven at a constant speed by a suitable means (not shown). The bobbin support arm 8 presses the cross-wound bobbin package 6, which in FIG. 1, e.g. is shown as a conical cross-wound bobbin package, against the friction drive drum 7. The bobbin package is thus driven by the friction between the friction drive drum 8 and the surface of the cross-wound bobbin package 6. In order to generate the frictional contact, the bobbin support arm 8 is loaded by suitable means (not shown).

The traversing thread guide 9 is mounted on a traversing rod 10 which also extends along all the spinning units of a whole machine side and which moves to and fro. In FIG. 1, the outermost positions of the traversing thread guide are designated 9 and 9'; the distance between the positions 9 and 9' corresponding to the winding traverse of the cross-wound bobbin package 6.

The type of winding means described here is, of course, not the only type of winding means which can be used. Thus, e.g. a winding device with a grooved drum in which a friction drive drum effects the thread or yarn traversing motion or a winding device with a directly driven bobbin chuck instead of a surface driven cross-wound bobbin package can be used.

During the traversing motion, the yarn 2 covers a so-called traversing triangle between the cross-wound bobbin package 6 and a fixed point which, e.g. is shown in FIG. 1, is a nip point located on the nip line k of the pair of take-off rolls 4, 5 but which may be located on a thread guide eyelet (not shown) arranged above the nip line k. This traversing triangle is referred to herein as a "yarn traversing path".

As shown in FIG. 1, a compensation rail 11 deflects the yarn within the yarn traversing path. This compensation rail 11 levels out the difference in yarn path length in the yarn path determined by the traversing triangle. For this purpose, the compensation rail 11 is provided with a convex contacting surface 12 directed upward along which the yarn slides and is deflected. Due to the presence of the compensation rail 11, the yarn path length is maintained constant over the whole traversing triangle in such a manner that the yarn tension is also maintained constant during the winding process. The winding tension thus only depends on the ratio of the delivery speed of the yarn take-off rolls 4, 5 and of the winding speed of the cross-wound bobbin package 6 taking into account the yarn elongation. A waxing apparatus is arranged within the traversing triangle limited by the two extreme thread path positions 13, 14.

Figure 2:
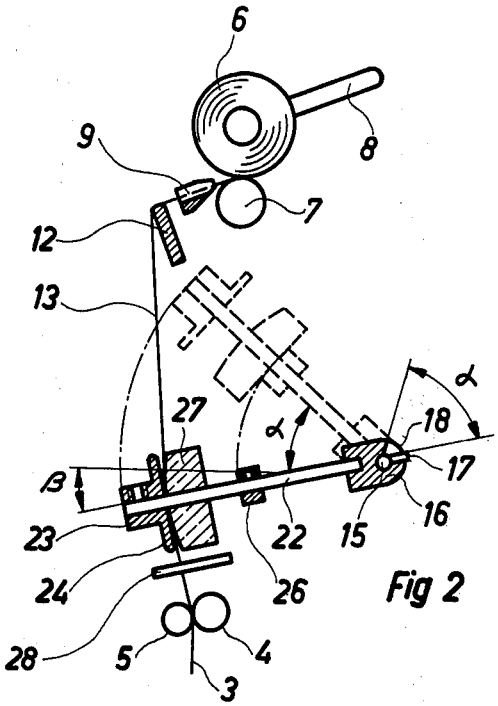
FIG. 2 illustrates a cross-sectional view of the waxing apparatus of FIG. 1.

Referring to FIGS. 1 and 2, the waxing apparatus is mounted on an axle which is rigidly supported substantially parallel to the longitudinal elements of the machine, e.g. to the rolls 4, 7 on the machine frame. The axle 15 can extend over the whole length of a side of the open-end spinning machine or also only over one or a limited number of spinning units. The waxing apparatus includes a support member 16 which is pivotably supported on the axle 15. The pivoting range of the support member 16 between two end positions is limited by a pin 17 which is rigidly connected with the axle 15 and protrudes through a suitable opening 18 in the support member 16. The pivoting angle $\alpha$ of the support member 16 thus can be determined by suitably choosing the arc length of the opening 18. The axial position of the support member 16 is determined by a stop ring 19 arranged on, and rigidly connected with the axle 15. A pressure spring 20 is arranged on the axle 15 on the other side of the support member 16 between the support member 16 and a ring 21 rigidly connected to the axle 15 in such a manner that the support member 16 is pressed against the stop ring 19 by the spring force. The support member 16 thus can be pivoted only if its friction against the stop ring 19 is overcome. This friction is sufficient to maintain any pivoting position in the range of the support member 16 and the elements connected therewith as described below. The elements which determine the axial position, limit the pivoting range and permit pivoting of the support member 16 under the influence of a determined force only, can of course be of other shapes and constructions.

The waxing apparatus further includes a cylindrical guide pin 22 which is rigidly supported in the support member 16, a stop at the free end of the pin 22 in the form of a cover 24 provided with a mounting flange 23 and a stop ring 26 at an intermediate point of the guide pin 22. The cover 24 and the stop ring 26 are slid onto and fixed to the guide pin 22 by means of a fixing screw 25, 25' respectively. In addition, a cylindrical waxing body 27 of solid wax is slid onto the guide pin 22 via a central bore between the cover 24 and the stop ring 26. The distance between the cover 24 and the stop ring 26 is selected to exceed the height of a new waxing body 27 not yet worn and the diameter of the central bore of the waxing body 27 is chosen such that the waxing body 27 is loosely slidable on the guide pin 22. The waxing body 27 thus can freely rotate on the guide pin 22 as well as slide axially between the two stops formed by the cover 24 and the stop ring 26.

The guide pin 2 is thus pivotally mounted on the horizontal axis defined by the axle 15 between a working position as shown in solid line in FIG. 2 and an idling position as shown in dotted line in FIG. 2. In the working position the pin 22 projects through the yarn traversing path at a downwardly inclined angle while in the idling position, the pin is located outside the path at an upwardly inclined angle. The pin 22 has a longitudinal axis which is disposed perpendicularly of the yarn traversing path with the pin in the working position.

In the working position of the waxing apparatus, the guide pin 22 forms an acute angle $\beta$ (FIG. 2) with respect to a horizontal plane. The free end of the pin 22 supporting the cover 24 is inclined downward and is arranged approximately at right angles to the traversing path described by the traversing yarn containing the extreme thread path positions 13, 14 (FIG. 1) and which can of course be slightly convex. The angle $\beta$ also determines the position of the traversing path in the space. The angle $\beta$ is chosen such that the waxing body 27 can slide under its own weight against the cover 24 until being worn off and is supported thereon. The choice of the angle $\beta$ thus depends, among other factors, on the sliding properties of the waxing body 27 on the guide pin 22, on the weight of the waxing body 27 in its new state and in its worn-off state and on the yarn tension prevailing between the pair of take-off rolls 4, 5 and the cross-wound bobbin 6. As shown in FIG. 1, the traversing yarn is guided between the cover 24 and the waxing body 27 if the waxing apparatus is in the working position, care being taken that the yarn passes along the waxing body 27 and is thus waxed in an enclosed or confined condition. The position of the waxing body 27 in this arrangement is chosen such, that the yarn in the yarn path is slightly deflected at the waxing body 27. This deflection is normally small and is maintained constant due to the fixed position of the cover 24. The deflection is clearly indicated in FIG. 2. In this arrangement, now, the waxing rate depends only on this deflection and on the yarn tension in such a manner that it remains constant independently of the weight of the waxing body. That is, the angle of yarn deflection remains constant for all weights of the waxing body 27, as even at the minimum weight the weight of a worn out waxing body is sufficient to deflect the yarn against the stops 24, i.e., the cover 24.

Due to the described arrangement of the waxing body 27 in the traversing zone of the yarn, the waxing body 27 is always set into rotation in the same direction by the yarn in such a manner that a uniform wear of the whole waxing body 27 along its face surface is ensured. Experience has proven that the rotation of the waxing body 27 is caused directly by or made possible by the radial movement of the yarn 2 on the face side of the waxing body 27 (i.e., by the traversing movement of the yarn). If the yarn would not traverse on the face side of the waxing body 27, but would merely pass along a fixed path, the waxing body 27 would not be set into rotation reliably. Thus, the use of an external means for rotating the waxing body would be required.

The described waxing apparatus achieves uniform wear of the waxing body 27 in a most simple manner which also beneficially influences the functional reliability of the apparatus.

As shown in FIG. 2, the guide pin 22 and related components can be pivoted upwardly by pivoting the support member 16 over the angle $\alpha$. The angle $\alpha$ in this arrangement is chosen such that the idling position of the waxing apparatus is located outside the traversing path of the yarn where the waxing apparatus no longer presents an obstacle for the execution of a spinning start-up process by the operator. In the pivoted-up idling position of the waxing apparatus, the guide pin 22 is inclined with respect to a horizontal plane in such a manner that the free end supporting the cover 24 points upward. In this position, the waxing body 27 can fall back against the stop ring 26. This creates very favorable conditions for rethreading the yarn into the waxing apparatus during a subsequent pivoting motion back to the working position. This is because the yarn can easily glide into the enlarged clearance prevailing between the cover 24 and the waxing body 27. The yarn, of course, glides into this clearance before the guide pin 22 is pivoted back completely into the working position, i.e., during the pivoting movement, the cover 24 intersects with the yarn path during its pivoting-back movement in a higher position, as clearly indicated in FIG. 2.

Due to the fact that the waxing apparatus is located outside the yarn path during the spinning start-up process of the yarn, with which operation, e.g. possible yarn end breakages are mended and that, during the subsequent pivoting back of the waxing apparatus, the rethreading of the yarn is effected automatically due to the described enlargement of the clearance, ideal conditions are thus created for the operating personnel. This precludes the danger of faulty manipulations and facilitates operation.

Referring to FIGS. 1 and 2, a yarn guide plate 28 is located astride the yarn path above the take-off rolls 4, 5 and below the working position of the waxing apparatus. This yarn plate 28 prevents the yarn from laterally escaping from the pressure roll 5 and thus from the waxing apparatus during the so-called back-feeding of the yarn into the spinning machine 1 during which operation the yarn is fed back from the cross-wound bobbin package 6 for a short time in order to repiece the yarn and resume the spinning process. In the normal operating position of the open-end spinning machine, the yarn does not contact the guide plate 28. Instead, the guiding function of the guide plate 28 is limited to the short time phase of the yarn back-feeding during the re-starting process of the machine.

Figure 3:
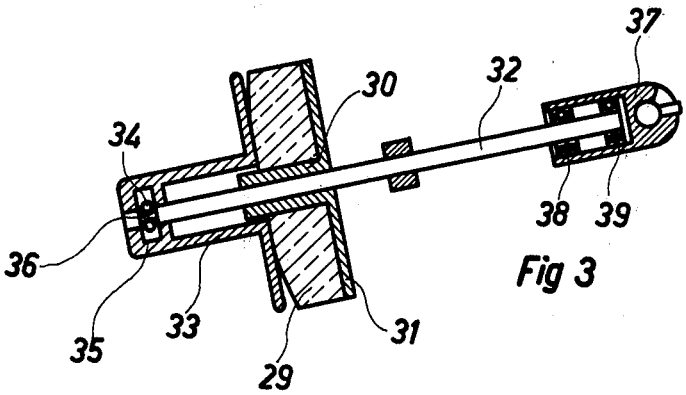
FIG. 3 illustrates a modified waxing apparatus in accordance with the invention.

Referring to FIG. 3, as mentioned above with respect to FIGS. 1 and 2, the good sliding properties of the waxing body on the guide pin have a decisive influence. In order to better meet these requirements, the waxing body 29 may alternatively be mounted on a guide sleeve 30 which has optimum sliding properties with respect to the guide pin 32 in such a manner that the axial slideability and the rotatability of the waxing body 29 and the sleeve 30 are better ensured. The guide sleeve 30 may also be equipped with a weighing disc 31, the function of which is to increase the weight of the waxing body 29. This embodiment has the further advantage that the guide sleeve 30 can be made from a material which is more wear-resistant than wax. Thus, the danger of the center bore of the waxing body 29 becoming non-round or eccentric is prevented.

As shown in FIG. 3, the stop cover 33 (which corresponds to the cover 24 shown in FIGS. 1 and 2) is provided with a quick-mounting means such as a snap-on device for securing the stop 33 on the guide pin 32. Such a snap-on device consists, e.g. of an open spring ring 34 which is arranged in a circular groove 35 of the cover 33 and which can adapt itself to a circular recess 36 of the guide pin 32. Other types of quick-mounting means (.e.g. of the type making use of the elastic deformation properties of the cover), of course are also applicable. The advantage of a snap-on device for the cover is that a worn-off waxing body can be replaced by a new waxing body quickly and without using tools.

As also shown in FIG. 3, the guide pin 32 is rotatably supported in the support member 37. This is effected, e.g. by two anti-friction bearings 38, 39. Thus, the friction problems of the waxing body 29 sliding on the guide pin 32 can be controlled more reliably, at least as far as rotational movement is concerned.

Among the advantages of the waxing apparatus are the following:

a. uniformity of the yarn waxing process;

b. unimpaired operation during the spinning start-up process;

c. prevention of any faulty manipulation of the waxing apparatus during the spinning start-up process;

d. possibility of deactivating the yarn waxing process without dismantling elements on individual or on all working positions of the textile machine; and e. simplicity, economically feasible manufacture and reliability of the waxing apparatus.

The invention thus provides a waxing apparatus which ensures constant waxing of the yarn independently of the weight of the wax body and of the friction of the wax body on a guide pin. Further, during a spinning start-up process on an open-end spinning machine, the waxing apparatus does not disturb the operators in any manner. Also, the waxing apparatus permits fast change-over from waxed yarns to non-waxed yarns, without any dismantling of parts and particularly without dismantling the wax body. These features are enhanced by the simplicity of the construction of the waxing apparatus.

What is claimed is:

1. In combination with an open-end spinning machine from which a yarn travels through a predetermined yarn path, an apparatus for waxing a yarn in said path, said apparatus consisting of a guide pin pivotally mounted on a horizontal axis for movement between a working position in which said pin projects through said path on a downwardly inclined angle and an idling position in which said pin is located outside said path on an upwardly inclined angle, said pin having a longitudinal axis disposed perpendicularly of said path with said pin in said working position;

a wax body of cylindrical shape rotatably and axially movably mounted on said guide pin; and a stop on said pin for determining the axial position of said wax body on said pin with said pin in said working position, said stop and said wax body being disposed on opposite sides of said path with said pin in said working position and with said wax body pressed against said stop in said working position under the weight of said wax body to deflect the yarn in said yarn path whereby a yarn is guided between a face side of said wax body and said stop for waxing of the yarn in a confined condition.

2. The combination as set forth in claim 1 wherein said stop is a cover supported on said guide pin.

3. The combination as set forth in claim 1 wherein said wax body is loosely supported on said guide pin.

4. The combination as set forth in claim 3 wherein said guide pin is rotatable about said longitudinal axis.

5. The combination as set forth in claim 1 wherein said guide pin is rotatable about said longitudinal axis.

6. The combination as set forth in claim 1 which further consists of a guide sleeve having said wax body mounted thereon, said guide sleeve being slidably mounted on said guide pin and being made of a material having good sliding characteristics relative to said guide pin, said sleeve having a weighting disc thereon.

7. The combination as set forth in claim 1 which further consists of a second stop on said guide pin between said horizontal axis and said wax body to maintain a space between said wax body and said horizontal axis.

8. The combination as set forth in claim 1 which further consists of a quick-mounting means for securing said stop on said guide pin.

9. The combination as set forth in claim 1 which further consists of a winding means for winding the yarn onto a cross-wound bobbin package while effecting a yarn traversing motion in said yarn path and across said wax body.

10. An apparatus for waxing a yarn moving through a yarn path, said apparatus consists of a guide pin pivotally mounted on a horizontal axis for vertical movement between a working position in which said pin projects through said path on a downwardly inclined angle and an idling position in which said pin is located outside said path on an upwardly inclined angle, said pin having a longitudinal axis disposed perpendicularly of said path with said pin in said working position;

a wax body of cylindrical shape rotatably and axially movably mounted on said guide pin; and a stop on said pin for determining the axial position of said wax body on said pin with said pin in said working position, said stop and said wax body being disposed on opposite sides of said path with said pin in said working position and with said wax body pressed against said stop in said working position under the weight of said wax body to deflect the yarn in said yarn path whereby a yarn is guided between a face side of said wax body and said stop for waxing of the yarn in a confined condition.

11. An apparatus as set forth in claim 10 wherein said guide pin is pivotal in an upward direction from said working position to said idling position, and which further consists of a second stop on said guide pin between said horizontal axis and said wax body to maintain a space between said wax body and said horizontal axis.

12. In an apparatus for waxing a traveling yarn, the combination consisting of an elongated guide pin pivotally mounted on a horizontal axis at one end for movement between a working position with said pin at a downwardly inclined angle and an idling position disposed above said working position with said pin at an upwardly inclined angle out of the path of yarn travel;

a wax body of annular shape rotatably and axially movably mounted on said guide pin; and a stop on said pin for determining the axial position of said wax body on said pin with said pin in said working position for waxing of a yarn guided between said wax body and said stop in a confined condition and with said wax body pressed against said stop in said working position under the weight of said wax body to deflect the yarn.

13. An apparatus as set forth in claim 12 wherein said guide pin is rotatable about a longitudinal axis thereof.

14. An apparatus as set forth in claim 12 wherein said guide pin is pivotal in an upward direction from said working position to said idling position, and which further consists of a second stop on said guide pin between said horizontal axis and said wax body to maintain a space between said wax body and said horizontal axis.

15. An apparatus as set forth in claim 12 which further consists of a quick-mounting means for securing said stop on said guide pin.

* * * * *